US006527530B2

(12) United States Patent
Boehland et al.

(10) Patent No.: US 6,527,530 B2
(45) Date of Patent: Mar. 4, 2003

(54) GEAR-WHEEL PUMP, IN PARTICULAR FOR A HIGH-PRESSURE FUEL PUMP

(75) Inventors: Peter Boehland, Marbach (DE); Robert Reitsam, Hallein (AT)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/009,490

(22) PCT Filed: Mar. 24, 2001

(86) PCT No.: PCT/DE01/01146

§ 371 (c)(1),
(2), (4) Date: Mar. 28, 2002

(87) PCT Pub. No.: WO01/79699

PCT Pub. Date: Oct. 25, 2001

(65) Prior Publication Data

US 2002/0106296 A1 Aug. 8, 2002

(30) Foreign Application Priority Data

Apr. 13, 2000 (DE) ..... 100 18 348

(51) Int. Cl.[7] ..... F04C 29/00
(52) U.S. Cl. ..... 418/180
(58) Field of Search ..... 418/180, 206.4, 418/206.1

(56) References Cited

U.S. PATENT DOCUMENTS 2,424,750 A * 7/1947 Heckert ..... 418/180
3,204,564 A * 9/1965 Eltze ..... 418/180
3,667,874 A * 6/1972 Weatherston et al. .... 418/206.4
RE29,627 E * 5/1978 Weatherston ..... 418/180
4,215,977 A * 8/1980 Weatherston ..... 418/180
6,033,197 A * 3/2000 Brown et al. ..... 418/180

FOREIGN PATENT DOCUMENTS

DE 3414064 A1 * 10/1985 ..... F04C/29/08
GB 2178485 A * 2/1987 ..... F04C/29/00

* cited by examiner

*Primary Examiner*—Thomas Denion
*Assistant Examiner*—Theresa Trieu
(74) *Attorney, Agent, or Firm*—Ronald E. Greigg

(57) ABSTRACT

A geared pump, having a housing (18), two gear wheels (14, 16) that are disposed in the housing and mesh with one another, and at least one groove (22) that is embodied in the housing on the pressure side of the geared pump, cavitation damage at high rpm is to be avoided. To that end, it is provided that the groove has a first portion (24), which extends from the pressure side, and in which the bottom of the groove (22) has a slight spacing from the tips of the teeth (20) of the gear wheel, and a second portion (26), which adjoins the first portion and in which the bottom of the groove (22) has a maximum spacing from the tooth tips that is greater than the spacing in the first portion, and the first portion extends over a smaller angular range (α) than the second portion, and the groove extends over a total angular range (α, β) that is somewhat greater than angular spacing between two teeth (20).

12 Claims, 2 Drawing Sheets

GEAR-WHEEL PUMP, IN PARTICULAR FOR A HIGH-PRESSURE FUEL PUMP

CROSS-REFERENCE TO RELATED APPLICATIONS

This application is a 35 USC 371 application of PCT/DE 01/01146 filed on Mar. 24, 2001.

BACKGROUND OF THE INVENTION

1. Field of the Invention

2. Description of the Prior Art

Such a pump can serve in particular as a prefeed pump for a high-pressure fuel pump, and the fuel is furnished to it by the prefeed pump at a pressure of about 6 bar. The high-pressure fuel pump then generates a pressure, which can be on the order of magnitude of as high as 1800 bar, of the kind used in a so-called common rail injection system.

The geared pump is driven at the same rpm as the high-pressure fuel pump and must furnish a sufficient quantity of fuel already when the engine is at its starting rpm. For this reason, it is necessary that the gear wheels run with as little play relative to the housing as possible and that the wrap length of the two gear wheels, that is, the angular range, over which the interstices between teeth, which are filled with a fuel to be pumped, between the intake side and the compression side of the geared pump are sealed off by the housing, must also be as great as possible. At maximum engine rpm, however, the geared pump must not pump an excessive fuel quantity. Instead of a complicated valve control for quantity regulation, typically a throttle is used on the intake side and defines this feed quantity. As a consequence, when a certain feed quantity is reached, the interstices between teeth are no longer completely filled with fuel.

If such an interstice between teeth, which is not completely filled with fuel, on the compression side of the pump emerges from the housing into the pressure chamber, there is the danger of cavitation damage at the tooth flanks of the gear wheel teeth or at the housing. For this reason the groove is provided, which is intended to enable the most continuous possible pressure increase in the interstice between teeth that is not completely filled with fuel. The groove functions like a throttle, which enables a controlled return flow of fuel from the compression side of the pump into the interstice between teeth located in the vicinity of the groove.

A disadvantage of the fuel pumps known until now is that a groove extending over a comparatively large angular range was necessary if cavitation damage even at high rpm is to be prevented. The great angular length of the groove, however, means that the wrap angle between the housing and the gear wheel decreases, resulting in a reduced feed quantity at lower rpm.

The object of the invention is to refine a geared pump of the type defined at the outset such that even at low rpm a large feed quality is attained, while at the same time at high rpm, cavitation damage is avoided.

SUMMARY OF THE INVENTION

In the geared pump of the invention the groove forms a kind of antechamber, which communicates with the compression side through the comparatively narrow gap that is formed in a first portion between the bottom of the groove and the tips of the gear wheel teeth. At high rpm, the narrow gap in conjunction with the overflow cross section, which is formed in the region of the second portion of the groove, leads to a continuous pressure increase in whichever interstice between teeth is just now opening toward the groove. The groove has a total length over a comparatively small angular range, resulting in a large wrap angle between the gear wheel and the housing, which is advantageous for the sake of the feed quantity at low rpm.

BRIEF DESCRIPTION OF THE DRAWINGS

The invention will be described below in terms of a preferred embodiment, with reference to the accompanying drawings, in which.

DESCRIPTION OF THE PREFERRED EMBODIMENT

Figure 1:
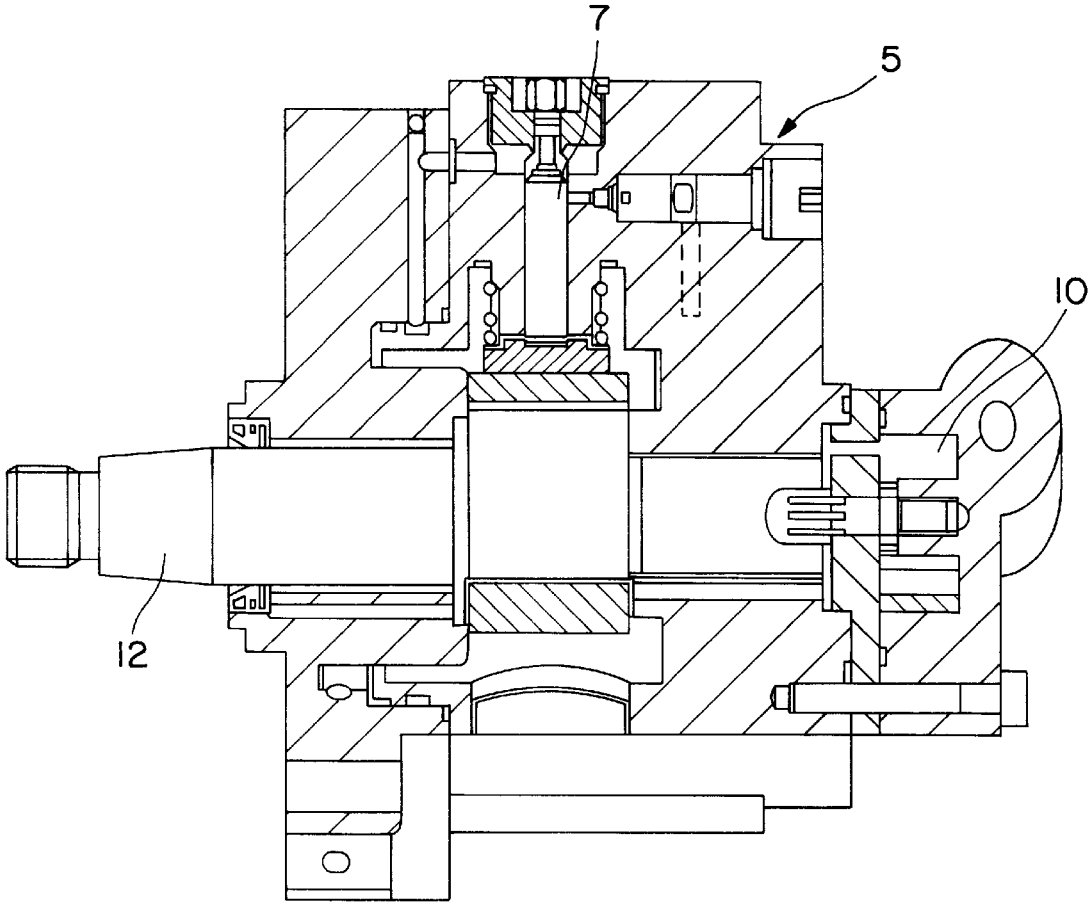
FIG. 1 is a schematic sectional view of a geared pump in conjunction with a high-pressure fuel pump.

In FIG. 1, a high-pressure fuel pump 5 is shown, which is capable of compressing fuel by means of a pump element 7 to a high pressure, on the order of magnitude of up to 1800 bar. The fuel is delivered to the pump element via a geared pump 10, which is connected to a drive shaft 12 for the pump element 7.

The geared pump 10 has two gear wheels 14, 16 (see FIG. 2), which mesh with one another and are disposed in a housing 18. By rotation in the direction of the central arrow on wheel 14, the gear wheels 14, 16 pump the fuel from the intake side ND, to the compression side HD by means of the interstice between two adjacent gear wheel teeth 20.

Figure 2:
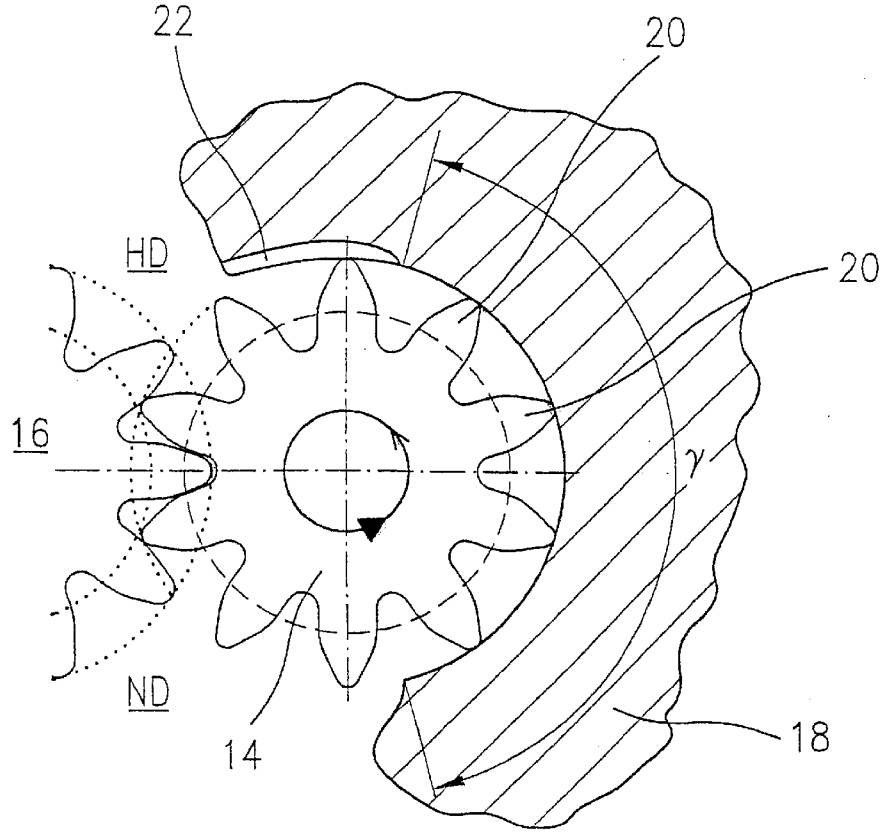
FIG. 2 is a schematic, fragmentary sectional view of a geared pump of the prior art.

In FIG. 2, a groove 22 can be seen, which is disposed in the housing, beginning at the compression side. The groove 22 serves to enable the most uniform possible, controlled pressure increase in the interstices between two adjacent gear wheel teeth, if there is a lesser pressure in the interstices between teeth at the outlet from the housing 18 and at the transition to the compression side than on the compression side and if the interstices between teeth are not completely filled with fuel. If an abrupt pressure increase were to occur in this state, the vapor bubbles in the fuel would implode in the interstices between teeth, and this could cause cavitation damage to the housing and to the flanks of the gear wheel teeth 20. The material that is vulnerable to cavitation damage would be affected particularly. In the conventional design of the groove 22, shown in FIG. 2, the pressure equalization in the interstices between teeth at high rpm occurs very fast, creating a pressure wave which on the one hand engenders severe pressure fluctuations and on the other causes the cavitation bubbles in the interstice between teeth to implode at high speed.

Figure 3:
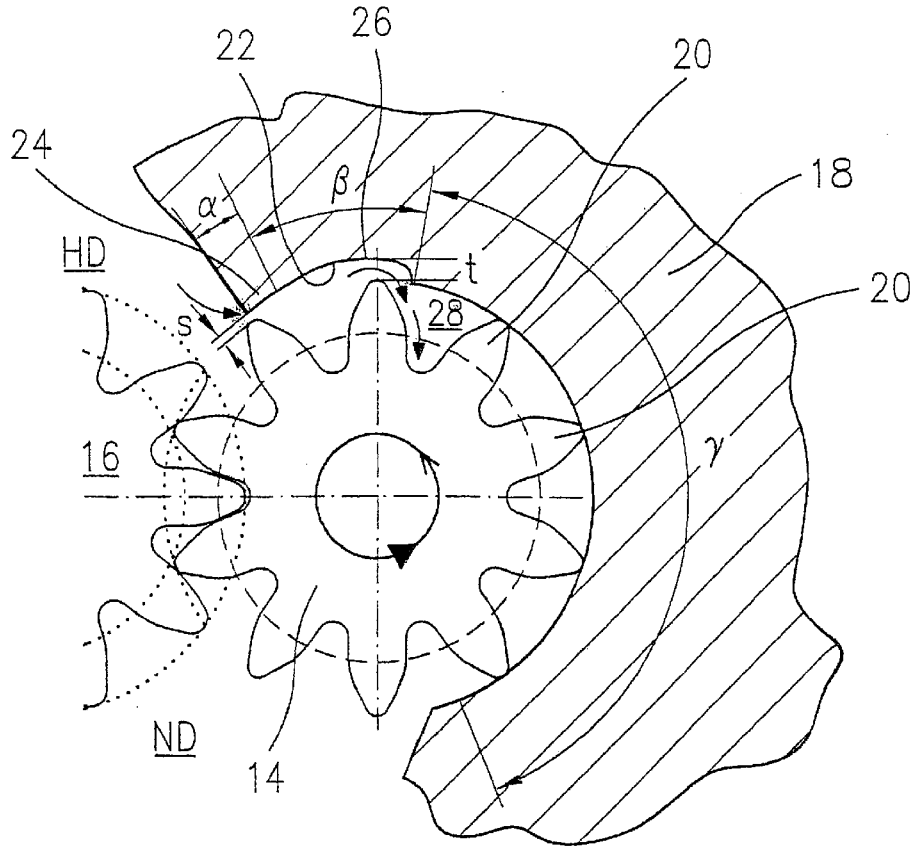
FIG. 3 is an elevation view corresponding to that of FIG. 2, showing a geared pump of the invention.

In FIG. 3, the design of the groove 22 according to the invention is shown. The groove here comprises a first portion 24, which extends over an angular range $\alpha$, and a second portion 26, which extends over an angular range β; the angular range α is much smaller than angular range β. In the angular range α, the spacing s between the tips of the gear wheel teeth and the bottom of the groove 22 is comparatively small, for instance on the order of magnitude of 0.2 mm, while the maximum spacing t between the tooth tips and the bottom of the groove 22 in the second portion is markedly greater, for instance on the order of magnitude of 0.7 mm. In the first portion, the bottom of the groove 22 extends approximately concentrically to the axis of rotation of the gear wheel 14, while in the second portion the bottom of the groove 22 extends approximately in a parabola beginning at the first portion. The contour of the groove in the second portion is selected such that, on its end remote from the first portion, it merges approximately radially with the region of the housing that rests closely against the gear wheel tips. In the embodiment shown, the angular range α is approximately 5°, while the angular range β is approximately 36°. The angular ranges are adapted to the spacing of the gear wheel teeth 20 from one another in such a way that the groove 22 extends over a total angular range that is slightly greater than the angular spacing between two gear wheel teeth. The result is a large wrap angle γ, that is, a large angular range, over which the interstices between teeth are covered by the housing between the intake side and the compression side. This large wrap angle γ is advantageous for the sake of low overflow losses at low rpm, or in other words for the sake of a large feed quantity.

The special design of the groove 22 leads to a continuous pressure increase in the region of the interstices between teeth at the transition of an interstice between teeth out of the region of the wrapping by the housing into the region of the compression side. At the beginning of the pressure increase, that is, when the gear wheel 14 is in the position shown in FIG. 3, in which a gear wheel tooth 20 located in the interstice 28 between teeth in question enters the second portion 26 of the groove 22, a comparatively narrow gap results between the housing and the corresponding gear wheel tooth, so that from a region at higher pressure, the fuel flows comparatively slowly into the interstice 28 between teeth. The flow extends radially, so that it follows the gear wheel flank in the direction of the tooth base. This is assured by the course of the contour of the groove 22 in this region. When the fuel overflows into the interstice between teeth that is to be filled up, the pressure in the preceding interstice between teeth drops, which in turn is compensated for by a replenishing flow of fuel through the narrow gap between the tooth tip and the bottom of the groove, in the first portion 24 thereof. When the gear wheel rotates onward in the direction of the arrow, both the flow cross section between the first portion 24 of the groove 22 and the tooth tip opposite it and the flow cross section between the subsequent gear wheel tooth and the end of the groove 22 both increase. This makes a complete pressure equalization possible in the interstice 28 between teeth before the exit to the compression side. In this way, cavitation damage to both the gear wheel teeth and to the housing of the geared pump is avoided.

It is understood that the groove 22 described can also be provided for the second gear wheel 16, in order to avoid cavitation damage there as well.

For the cross-sectional design of the groove 22, the following rules apply:

$$1/(N \cdot Z) \geq T_f$$

$$T_f = V_d / V_p$$

$$A_N = V_p / w$$

in which $T_f$=filling time for an interstice between teeth through the groove

N=rpm of gear wheel

Z=number of teeth of the gear wheel $V_d$=vapor volume in the interstice between teeth $V_p$=volumetric flow of fuel through the groove to the interstice between teeth w=flow velocity in the groove $A_N$=effective flow cross section in the groove The foregoing relates to preferred exemplary embodiment of the invention, it being understood that other variants and embodiments thereof are possible within the spirit and scope of the invention, the latter being defined by the appended claims.

What is claimed is:

1. A geared pump, comprising a housing (18), two gear wheels (14, 16) disposed in the housing and meshing with one another, and at least one groove (22) that is embodied in the housing on the pressure side of the geared pump, said at least one groove having a first portion (24) extending from the pressure side where it originates with a slight spacing between the bottom of the groove (22) and the tips of the teeth (20) of the gear wheel, and a second portion (26), which adjoins said first portion and in which the bottom of the groove (22) has a maximum spacing from the tooth tips that is greater than the spacing in the first portion, said first portion extending over a smaller angular range (α) than the second portion, and the first and second portions extending over a total angular range (α, β) that is somewhat greater than angular spacing between two teeth (20).

2. The geared pump of claim 1, wherein the contour of the first portion of the groove (22) has a course such that a constant cross section results.

3. The geared pump of claim 2, wherein the contour of the second portion of the groove (22) has a course such that a decreasing cross section results.

4. The geared pump of claim 3, wherein the contour of the second portion of the groove (22) has a parabolic course.

5. The geared pump of claim 4, wherein the contour of the second portion (26), on the side remote from the first portion (24), extends approximately radially with respect to the axis of rotation of the corresponding gear wheel.

6. The geared pump of claim 1, wherein the contour of the second portion of the groove (22) has a course such that a decreasing cross section results.

7. The geared pump of claim 6, wherein the contour of the second portion of the groove (22) has a parabolic course.

8. The geared pump of claim 7, wherein the contour of the second portion (26), on the side remote from the first portion (24), extends approximately radially with respect to the axis of rotation of the corresponding gear wheel.

9. The geared pump of claim 1, wherein it is associated with a high-pressure fuel pump (5), and the spacing (t)

between the tooth tips and the bottom of the groove in the second portion is approximately equal to the effective flow cross section in the groove, divided by the gear wheel height, while the spacing (s) between the tooth tips of the gear wheel (14, 16) and the bottom of the groove (22) in the first portion is equal to approximately one-third the spacing in the second portion.

10. The geared pump of claim 9, wherein the spacing (t) between the tooth tips and the bottom of the groove in the second portion is equal to approximately 0.7 mm.

11. The geared pump of claim 9, wherein the spacing (s) between the tooth tips of the gear wheel (14, 16) and the bottom of the groove (22) in the first portion is equal to approximately 0.2 mm.

12. The geared pump of claim 9, wherein the first portion (24) of the groove (22) extends over an angular range of approximately 5°, while the second portion (26) extends over an angular range of approximately 36°.

* * * * *